US008083990B2

(12) United States Patent
Ishida et al.

(10) Patent No.: US 8,083,990 B2
(45) Date of Patent: Dec. 27, 2011

(54) IRON-BASED ALLOY HAVING SHAPE MEMORY PROPERTIES AND SUPERELASTICITY AND ITS PRODUCTION METHOD

(75) Inventors: Kiyohito Ishida, Sendai (JP); Ryosuke Kainuma, Natori (JP); Yuji Sutou, Sendai (JP); Yuuki Tanaka, Sendai (JP)

(73) Assignee: Japan Science and Technology Agency, Saitama-ken (JP)

( * ) Notice: Subject to any disclaimer, the term of this patent is extended or adjusted under 35 U.S.C. 154(b) by 437 days.

(21) Appl. No.: 12/092,022

(22) PCT Filed: Nov. 2, 2006

(86) PCT No.: PCT/JP2006/321996

§ 371 (c)(1), (2), (4) Date: Apr. 29, 2008

(87) PCT Pub. No.: WO2007/055155

PCT Pub. Date: May 18, 2007

(65) Prior Publication Data

US 2009/0242083 A1 Oct. 1, 2009

(30) Foreign Application Priority Data

Nov. 9, 2005 (JP) ..... 2005-325393

(51) Int. Cl.

*C22C 38/06* (2006.01)
*C22C 38/08* (2006.01)
*C22C 38/10* (2006.01)

(52) U.S. Cl. ..... 420/95; 148/320; 148/336; 148/563; 420/8; 420/80

(58) Field of Classification Search ..... 148/320, 148/336, 563, 579, 651, 653, 654; 420/8, 420/77, 80, 94, 95, 103

See application file for complete search history.

(56) References Cited

U.S. PATENT DOCUMENTS 5,173,131 A 12/1992 Mantel

FOREIGN PATENT DOCUMENTS

EP 0 387 976 9/1990

(Continued)

OTHER PUBLICATIONS

English language machine translation of JP05255815.*

(Continued)

*Primary Examiner* — Stanley Silverman
*Assistant Examiner* — Brian Walck
(74) *Attorney, Agent, or Firm* — Sughrue Mion, PLLC

(57) ABSTRACT

An iron-based alloy having shape memory properties and superelasticity, which has a composition comprising 25-35% by mass of Ni, 13-25% by mass of Co, 2-8% by mass of Al, and 1-20% by mass in total of at least one selected from the group consisting of 1-5% by mass of Ti, 2-10% by mass of Nb and 3-20% by mass of Ta, the balance being substantially Fe and inevitable impurities, and a recrystallization texture substantially comprising a γ phase and a γ' phase, particular crystal orientations of the γ phase being aligned, and the difference between a reverse transformation-finishing temperature and a martensitic transformation-starting temperature being 100° C. or less in the thermal hysteresis of martensitic transformation and reverse transformation.

4 Claims, 9 Drawing Sheets

FOREIGN PATENT DOCUMENTS

| | | | |
|---|---|---|---|
| JP | 61-106746 | A | 5/1986 |
| JP | 03-257141 | A | 11/1991 |
| JP | 5-255815 | | 10/1993 |
| JP | 09-176729 | A | 7/1997 |
| JP | 2000-017395 | A | 1/2000 |
| JP | 2003-268501 | A | 9/2003 |

OTHER PUBLICATIONS

ScienceDirect—Scripta Materialia: Stress-Induced FCC/FCT phase transformation in Fe-Pd alloy, http://www.scienedirect.com/science, obtained Mar. 26, 2008.

Canadian Office Action dated Dec. 3, 2010.

* cited by examiner

IRON-BASED ALLOY HAVING SHAPE MEMORY PROPERTIES AND SUPERELASTICITY AND ITS PRODUCTION METHOD

This is a 371 of Application No. PCT/JP2006/321996 filed Nov. 2, 2006, claiming the priority of JP 2005-325393, filed Nov. 9, 2005, both of which are hereby incorporated by reference.

FIELD OF THE INVENTION

The present invention relates to an iron-based alloy having excellent shape memory properties and superelasticity as well as good workability, corrosion resistance and magnetic properties in a practically usable temperature range.

BACKGROUND OF THE INVENTION

Shape memory alloys having one-way or two-way shape memory properties and superelasticity (pseudoelasticity), such as Ni—Ti alloys, Cu—Zn—Al alloys and Fe—Mn—Si alloys, are put into practical use, and most mass-produced are Ni—Ti alloys having excellent properties such as shape memory properties, mechanical strength, etc. However, the Ni—Ti alloys are disadvantageous in poor cold workability, a high material cost, etc. The Cu—Zn—Al alloys have poor corrosion resistance and suffer a high working cost.

As compared with these nonferrous shape memory alloys, iron-based shape memory alloys having a low material cost and good workability are expected to be used for various applications. However, iron-based shape memory alloys developed so far have much poorer superelasticity than that of the nonferrous shape memory alloys, not suitable for applications utilizing superelasticity.

Why conventional iron-based alloys do not have good superelasticity appears to be due to the fact that plastic strain such as dislocation is introduced, and that irreversible martensite (lenticular martensite) which does not have shape memory properties and superelasticity is stress-induced by deformation. To solve these problems, the strengthening of matrix, particularly precipitation strengthening by intermetallic compounds, has been considered effective. From this point of view, an Fe—Ni—Co—Al—C alloy (JP 03-257141 A), an Fe—Ni—Al alloy (JP 2003-268501 A), and an Fe—Ni—Si alloy (JP 2000-17395 A) were proposed. However, even these iron-based shape memory alloys are not necessarily satisfactory in a recoverable strain due to superelasticity, a recovery ratio, superelastically operable temperatures, etc. for practical applications.

"Scripta Materialia" Vol. 46, pp. 471-475 proposes an Fe—Pd alloy containing a large amount of expensive Pd and having a superelasticity. In this alloy, however, the amount of a recoverable strain due to superelasticity is as small as 1% or less.

JP 09-176729 A discloses an Fe—Mn—Si-based alloy utilizing fcc/hcp transformation to exhibit shape memory properties and superelasticity. However, because this Fe—Mn—Si-based alloy exhibits superelasticity only at a higher temperature than room temperature, it cannot be used at room temperature. In addition, because this alloy has poor corrosion resistance and cold workability, needing complicated working and heat treatment, resulting in a high production cost.

U.S. Pat. No. 5,173,131 discloses an iron-based shape memory alloy having a composition comprising 9-13% by weight of Cr, 15-25% by weight of Mn, and 3-6% by weight of Si, the balance being Fe and inevitable impurities, which meets 1.43 (% Si)+1 (% Cr)≦17. In this iron-based shape memory alloy, the difference between a martensitic transformation temperature (Ms) and a reverse transformation temperature (Af) measured by DSC is 110° C. However, this iron-based shape memory alloy is not necessarily satisfactory in a recoverable strain due to superelasticity and a recovery ratio for practical applications.

OBJECT OF THE INVENTION

Accordingly, an object of the present invention is to provide an iron-based alloy having excellent shape memory properties and superelasticity and good workability, corrosion resistance and magnetic properties in a practical temperature range, and its production method.

DISCLOSURE OF THE INVENTION

As a result of intense research in view of the above object, the inventors have found that an iron-based shape memory alloy can be provided with excellent shape memory properties and superelasticity by (a) setting the difference between a reverse transformation-finishing temperature (Af) and a martensitic transformation-starting temperature (Ms) to 100° C. or less in the thermal hysteresis of martensitic transformation and reverse transformation, and (b) working under the conditions of providing a recrystallization texture in which the particular crystal orientations of a γ phase constituting the matrix are aligned. The present invention has been completed based on such finding.

The iron-based alloy of the present invention having shape memory properties and superelasticity has a composition comprising 25-35% by mass of Ni, 13-25% by mass of Co, 2-8% by mass of Al, and 1-20% by mass in total of at least one selected from the group consisting of 1-5% by mass of Ti, 2-10% by mass of Nb and 3-20% by mass of Ta, the balance being substantially Fe and inevitable impurities, and a recrystallization texture substantially composed of a γ phase and a γ' phase, particular crystal orientations of the γ phase being aligned and a martensitic transformation-starting temperature being 100° C. or less in the thermal hysteresis of martensitic transformation and reverse transformation.

The particular crystal orientations of the γ phase are preferably aligned to a cold-working direction. The frequency of particular crystal orientations of the γ phase (measured by an electron backscattering pattern method) is preferably 2 or more in the cold-working direction. The particular crystal orientation is preferably <100> or <110>. 20% or more of the grain boundaries of the γ phase are preferably low-angle grain boundaries having orientation differences of 15° or less.

In the iron-based alloy, the Ni content is preferably 26-30% by mass, and the Al content is preferably 4-6% by mass.

The iron-based alloy of the present invention preferably further comprises 0.001-1% by mass in total of at least one selected from the group consisting of B, C, Ca, Mg, P, S, Zr, Ru, La, Hf, Pb and a misch metal.

The iron-based alloy of the present invention preferably further comprises 0.001-10% by mass in total of at least one selected from the group consisting of Be, Si, Ge, Mn, Cr, V, Mo, W, Cu, Ag, Au, Ga, Pd, Re and Pt.

The method of the present invention for producing an iron-based alloy having shape memory properties and superelasticity, which has a recrystallization texture substantially composed of a γ phase and a γ' phase, particular crystal orientations of the γ phase being aligned and the difference between a reverse transformation-finishing temperature and a martensitic transformation-starting temperature being 100° C. or less in the thermal hysteresis of martensitic transformation and reverse transformation, comprises repeating cold working via annealing plural times, with a total cold-working ratio after final annealing set such that the frequency of particular crystal orientations of the γ phase (measured by an electron backscattering pattern method) is 2 or more in a cold-working direction.

The total cold-working ratio after the final annealing is preferably 50% or more. It is preferable to conduct after the above cold working a solution treatment at a temperature of 800° C. or higher, and then an aging treatment at a temperature of 200° C. or higher and lower than 800° C.

The iron-based alloy produced by the method of the present invention preferably has a composition comprising 25-35% by mass of Ni, 13-25% by mass of Co, 2-8% by mass of Al, and 1-20% by mass in total of at least one selected from the group consisting of 1-5% by mass of Ti, 2-10% by mass of Nb and 3-20% by mass of Ta, the balance being substantially Fe and inevitable impurities.

The iron-based alloy produced by the method of the present invention preferably comprises 26-30% by mass of Ni and 4-6% by mass of Al. The iron-based alloy produced by the method of the present invention preferably further comprises 0.001-1% by mass in total of at least one selected from the group consisting of B, C, Ca, Mg, P, S, Zr, Ru, La, Hf, Pb and a misch metal.

The iron-based alloy produced by the method of the present invention preferably further comprises 0.001-10% by mass in total of at least one selected from the group consisting of Be, Si, Ge, Mn, Cr, V, Mo, W, Cu, Ag, Au, Ga, Pd, Re and Pt.

BRIEF DESCRIPTION OF THE DRAWINGS

FIG. 3(*b*) is a graph showing a method for determining superelasticity strain from the stress-strain curve of the shape memory alloy.

FIG. 5(*b*) is a schematic view showing steps for fabricating the iron-based alloy of Example 7 from a first annealing step to an aging step FIG. 5(*c*) is a schematic view showing steps for fabricating the iron-based alloy of Example 8 from a first annealing step to an aging step.

FIG. 5(*d*) is a schematic view showing steps for fabricating the iron-based alloy of Example 9 from a first annealing step to an aging step.

FIG. 5(*e*) is a schematic view showing steps for fabricating the iron-based alloy of Comparative Example 2 from a first annealing step to an aging step.

DESCRIPTION OF THE PREFERRED EMBODIMENTS

Figure 1:
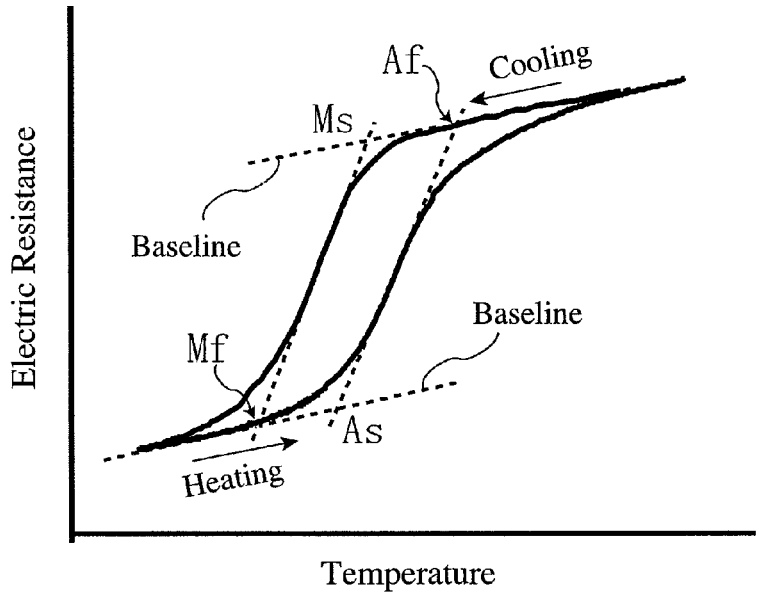
FIG. 1 is a graph schematically showing a typical electric resistance curve of the shape memory alloy.

[1] Composition of Iron-Based Alloy (a) Basic Composition

The iron-based alloy of the present invention has a basic composition comprising basic elements comprising 25-35% by mass of Ni, 13-25% by mass of Co and 2-8% by mass of Al, and 1-20% by mass in total of at least one first additional element selected from the group consisting of 1-5% by mass of Ti, 2-10% by mass of Nb and 3-20% by mass of Ta, the balance being substantially Fe and inevitable impurities. The amount of each element is expressed herein by "% by mass" per 100% by mass of the entire alloy, unless otherwise particularly mentioned.

Ni is an element causing martensitic transformation and lowering the transformation temperature. The iron-based alloy of the present invention contains 25-35% by mass of Ni. The inclusion of Ni in this range lowers the martensitic transformation temperature of the iron-based alloy, resulting in a stabilized matrix (γ phase with fcc structure). When the Ni content is more than 35% by mass, the martensitic transformation temperature is too low to cause the transformation in a practical temperature range, failing to obtain good shape memory properties and superelasticity.

Ni is an element for precipitating fcc and/or fct ordered phases such as $Ni_3Al$, etc. by an aging treatment. The ordered phases strengthen the matrix of the iron-based alloy and reduce a thermal hysteresis of martensitic transformation, thereby improving the shape memory properties and the superelasticity. When the Ni content is less than 25% by mass, the amounts of ordered phases precipitated by an aging treatment are insufficient, and good shape memory properties and superelasticity can't be obtained. The more preferred Ni content is 26-30% by mass.

Co is an element for increasing the amount of the γ' ordered phase which hardens the matrix, lowering the rigidity of the matrix to reduce a volume change by martensitic transformation, thereby improving the shape memory properties. The iron-based alloy of the presently invented contains 13-25% by mass of Co. When the Co content exceeds 25% by mass, the cold workability of the alloy lowers. When the Co content is less than 13% by mass, sufficient effects cannot be obtained by the addition of Co. The more preferred Co content is 15-23% by mass.

Al is an element for precipitating γ' ordered phases of fcc and/or fct such as $Ni_3Al$, etc. by an aging treatment, like Ni. When the Al content is less than 2% by mass, too little ordered phases are precipitated by aging to obtain good shape memory properties and superelasticity. When the Al content exceeds 8% by mass, the alloy becomes extremely brittle. Al contained in the iron-based alloy of the present invention is preferably 2-8% by mass, more preferably 4-6% by mass.

The inclusion of the first additional element such as Ti, Nb and Ta extremely increases the amount of γ' ordered phases precipitated, thereby drastically increasing the matrix strength and largely reducing the thermal hysteresis of martensitic transformation, which leads to improvement in shape memory properties and superelasticity. When the total amount of these elements exceeds 20% by mass, the cold workability of the alloy is likely to lower.

(b) Other Elements than Basic Composition

The iron-based alloy of the of the present invention may further contain at least one second additional element selected from the group consisting of B, C, Ca, Mg, P, S, Zr, Ru, La, Hf, Pb and a misch metal. The total amount of the second additional element is preferably 1% or less by mass, more preferably 0.001-1% by mass, most preferably 0.002-0.7% by mass. The second additional element suppresses the grain boundary reaction of a β phase having a B2 structure during the aging, thereby improving shape memory properties and superelasticity.

The iron-based alloy of the present invention may further contain at least one third additional element selected from the group consisting of Be, Si, Ge, Mn, Cr, V, Mo, W, Cu, Ag, Au, Ga, Pd, Re and Pt. The total amount of the third additional elements is preferably 10% or less by mass, more preferably 0.001-10% by mass, most preferably 0.01-8% by mass.

Among the third additional elements, Si, Ge, V, Mo, W, Ga and Re improve the coherency between the matrix-constituting γ phase and the γ' ordered phase, thereby enhancing the precipitation strengthening of the γ' phase, which improves the shape memory properties. The preferred total amount of these elements is 10% or less by mass.

Be and Cu provide the solution strengthening of the matrix-constituting γ phase, thereby improving the shape memory properties. The preferred content of Be and Cu are respectively 1% or less by mass.

Cr is an element effective for enhancing wear resistance and corrosion resistance. The preferred Cr content is 10% or less by mass.

Mn decreases the Ms temperature, and thereby reduces the amount of expensive Ni. The preferred Mn content is 5% or less by mass.

Ag, Au, Pd and Pt have a effect to increase a tetragonality of α' martensite, thereby reducing the thermal hysteresis of martensitic transformation and improving shape memory properties and superelasticity. The preferred amount of these elements is 10% or less by mass.

[2] Production Method of Iron-Based Alloy (a) Cold Working

The iron-based alloy of the present invention having the above composition is cast, hot-worked and cold-worked to a desired shape. After working, a solution treatment and an aging treatment are conducted. The working before the solution treatment is preferably cold working such as cold rolling, cold drawing, pressing, etc. After the cold working, if necessary, surface-working such as shot peening, etc. may be conducted. The cold working produces plates, pipes, wires, etc., in which the particular crystal orientations of the γ phase are aligned to a working direction.

Because a working ratio achieved by one cold-working step of the iron-based alloy is about 10% at most, the cold working should be repeated plural times to achieve a high total working ratio. In this case, annealing may be conducted plural times between cold working. To align the orientations of the γ phase, however, the total working ratio after the final annealing is preferably as high as possible. The annealing is preferably conducted at a heating temperature of 800-1400° C. for 1 minute to 3 hours. The cooling after the annealing is conducted preferably by air cooling, more preferably by quenching in water.

In the method of the present invention, the <100> or <110> direction of the γ phase is aligned to the direction of cold working such as rolling and drawing. The crystal orientation of the γ phase can be measured by an electron backscattering pattern method, to determine the frequency of aligned crystal orientations. For instance, the frequency of <100> in a working direction is defined assuming that it is 1 when the crystal orientations are completely random. The larger the frequency of <100> is, the more the <100>crystal orientations are aligned to a working direction.

Intense research has revealed that when the frequency of particular crystal orientations such as <100> or <110> of the γ phase is 2 or more, the resultant iron-based alloy has excellent shape memory properties and superelasticity. In the iron-based alloy of present invention, the frequency of particular crystal orientations can be controlled by adjusting the total working ratio after the final annealing. To increase the frequency of particular crystal orientations, a higher total working ratio is preferable after the final annealing. To obtain the frequency of 2 or more, the total cold-working ratio after the final annealing should be 50% or more in any alloy composition. A low total cold-working ratio after the final annealing does not align particular crystal orientations of the γ phase to the working direction, failing to improve shape memory properties and superelasticity sufficiently. The total cold-working ratio is preferably 70% or more, more preferably 92% or more.

(b) Solution Treatment

The cold-worked iron-based alloy is preferably subjected to a solution treatment comprising heating the alloy to a solution temperature to transform a γ-single phase and rapidly cooling the alloy. The solution treatment is conducted at a temperature of 800° C. or higher. The treating temperature is preferably 900-1400° C. The time period of holding the treating temperature is preferably 1 minute to 50 hours. The solution treatment for less than 1 minute fails to provide a sufficient effect. When the solution treatment time exceeds 50 hours, influence by oxidation becomes nonnegligible.

The solution treatment may be conducted while applying a stress. By this so-called tension annealing, the shape of the iron-based alloy can be precisely controlled. The stress applied during the solution treatment is preferably 0.1-50 $kgf/mm^2$.

After the heat treatment, the alloy is rapidly cooled at a speed of 50° C./second or more to obtain a γ-single phase state. The rapid cooling can be conducted by quenching in various baths such as water, or by air cooling. When the cooling speed is less than 50° C./second, a β phase having a B2 structure precipitates, failing to obtain shape memory properties. The preferred cooling speed is 50° C./second or more.

(c) Aging Treatment

After the solution treatment, an aging treatment is preferably conducted. Aging precipitates ordered phases with an fcc and/or fct structure such as $Ni_3Al$ in the γ-matrix, strengthening the matrix and reducing the thermal hysteresis of martensitic transformation, thereby improving the shape memory effect and superelasticity. The aging treatment is conducted at a temperature of 200° C. or higher and lower than 800° C. The ordered phases do not precipitate sufficiently by the treatment at temperatures below 200° C. The treatment at temperature above 800° C. precipitates the undesirable β phase with a B2 structure.

The aging time for the iron-based shape memory alloy may vary depending on the composition and treating temperature. The aging time is preferably 10 minutes to 50 hours at a temperature of 700° C. or higher and lower than 800° C. Also, the aging time is preferably 30 minutes to 200 hours at a temperature of 200° C. or higher and lower than 700° C. A shorter aging time than above would not provide sufficient effects of the ordered phase. If the aging time is longer than that mentioned above, a β phase would precipitate, which lose the shape memory properties.

[3] Crystal Structure and Properties of Iron-Based Alloy

The iron-based alloy of the present invention has a two-phase structure in which a γ' ordered phase having an $L1_2$ structure is finely dispersed in a γ phase having a face-centered cubic (fcc) structure substantially constituting the matrix. When the γ phase is cooled, it is subjected to martensitic transformation to an α' martensite phase having with a body-centered tetragonal (bct) structure. When the α' martensite phase is heated, it is subjected to reverse transformation to the matrix-constituting γ phase. A martensitic transformation-starting temperature (Ms), and a reverse transformation-finishing temperature (Af) can be determined by electric resistance measurement. As shown in FIG. 1, the shape memory alloy generally has hysteresis in martensitic transformation and its reverse transformation. The martensitic transformation-starting temperature (Ms) can be determined from an electric resistance curve in the cooling process, and the reverse transformation-finishing temperature (Af) can be determined from an electric resistance curve in the heating process.

The superelasticity of the shape memory alloy is obtained by the stress-induced martensitic transformation and its reverse transformation at Af or higher. However, in the alloy with a wide hysteresis, since the stress to induce the martensite is high, a permanent strain such as dislocation is easily introduced to the γ-matrix, and thereby good superelasticity cannot be obtained. Thus, by reducing the hysteresis, the martensitic transformation can be stress-induced in a low stress, so that a permanent strain such as dislocation is not introduced when the alloy is deformed, thereby obtaining good superelasticity. Intense research has revealed that to obtain such superelasticity, the iron-based alloy of present invention should have a thermal hysteresis width of 100° C. or less. The preferred thermal hysteresis width is 70° C. or less.

The iron-based alloy of present invention has a recrystallization texture in which particular crystal orientations of the γ phase constituting the matrix has aligned. The crystal orientations in the alloy structure can be measured by an electron backscattering pattern method, and the degree of alignment of the crystal orientations is defined by a frequency. The particular crystal orientations of each γ phase are preferably aligned to a cold-working direction such as rolling, drawing, etc., and the particular crystal orientation is preferably a <100> or <110>direction. The frequency of <100> in a working direction is defined assuming that it is 1 when the crystal orientations are completely random. The larger the frequency of <100> is, the more the <100>crystal orientations are aligned to working direction. In the iron-based alloy of present invention, the frequency of particular crystal orientations in a working direction is preferably 2 or more, more preferably 2.5 or more.

The iron-based alloy of present invention, which has a thermal hysteresis of 100° C. or more and aligned crystal orientations of the matrix-constituting γ phase, stably has better shape memory properties and superelasticity than the conventional iron-based alloys in a practical temperature range. The shape recovery ratio is about 80% or more, the superelasticity is 0.5% or more, and the yield stress (0.2% yield) is about 600 MPa or more. Further, the iron-based shape memory alloy of present invention has good hardness, tensile strength, rupture elongation and excellent workability.

The present invention will be described in more detail referring to Examples below without intension of restricting the present invention thereto.

Examples 1-5 and Comparative Example 1

The iron-based alloys of Examples 1-5 and Comparative Example 1 were produced by the following method with the compositions and aging time shown in Table 1.

Figure 2:
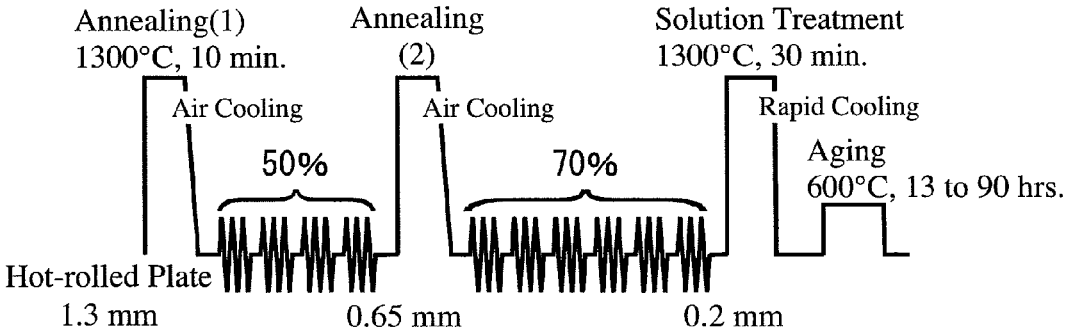
FIG. 2 is a schematic view showing one example of steps for fabricating the iron-based alloy from a first annealing step to an aging step.

Each alloy comprising the components shown in Table 1 was melted, and solidified at a cooling speed of 140° C./minute on average to produce a billet of 12 mm in diameter. This billet was hot-rolled at 1300° C. to produce a 1.3-mm-thick plate. This hot-rolled plate was subjected to first annealing at 1300° C. for 10 minutes, and then to cold rolling plural times to a thickness of 0.65 mm. The plate was subjected to second annealing under the same condition and then cold-rolled plural times to a thickness of 0.2 mm. The total working ratio after the second annealing (final annealing) was 70%. Each plate was heat-treated at 1300° C. for 30 minutes, and then rapidly cooled by quenching in ice water (solution treatment). It was then subjected to an aging treatment at 600° C. for the time period shown in Table 1, to obtain iron-based alloy plates having a two-phase structure comprising a γ phase having a fcc structure and a γ' phase having an $L1_2$ structure, which had shape memory properties and superelasticity. This fabrication process from the first annealing step to the aging step is schematically shown in FIG. 2.

TABLE 1

| | Alloy Composition (% by mass) | | | | | | | Other Elements | Aging Treatment |
|---|---|---|---|---|---|---|---|---|---|
| No. | Fe | Ni | Co | Al | Ti | Nb | Ta | (% by mass) | Time (h) |
| Example 1 | 46.4 | 30.7 | 14.9 | 5.8 | 2.2 | — | — | — | 48 |
| Example 2 | 45.5 | 30.0 | 14.6 | 5.7 | — | 4.2 | — | — | 60 |
| Example 3 | 43.6 | 28.9 | 14.0 | 5.5 | — | — | 8.0 | — | 60 |

TABLE 1-continued

| No. | Alloy Composition (% by mass) Fe | Ni | Co | Al | Ti | Nb | Ta | Other Elements (% by mass) | Aging Treatment Time (h) |
|---|---|---|---|---|---|---|---|---|---|
| Example 4 | 40.2 | 28.8 | 17.6 | 5.4 | — | — | 8.0 | B: 0.01 | 90 |
| Example 5 | 38.8 | 27.7 | 17.2 | 5.3 | — | — | 7.8 | W: 3.2 | 72 |
| Comp. Ex. 1 | 49.5 | 34.0 | 10.0 | 6.5 | — | — | — | — | 13 |

With respect to the iron-based alloys of Examples 1-5 and Comparative Example 1, the temperature width [difference between Af (reverse transformation-finishing temperature) and Ms (martensitic transformation-starting temperature)] of the thermal hysteresis of martensitic transformation and reverse transformation, the frequency of <100> in a rolling direction, a shape recovery ratio by shape memory, and the maximum superelasticity strain (superelasticity) were measured by the following methods. The results are shown in Table 2.

(1) Temperature Width (Difference Between Af and Ms) of Thermal Hysteresis

The Ms and Af of the iron-based alloy plates were determined by electric resistance measurement (see FIG. 1), and their difference was regarded as the temperature width of thermal hysteresis.

(2) Frequency of <100> in Rolling Direction

Using an electron backscattering pattern analyzer (Orientation Imaging Microscope available from TSL), the frequency of particular orientations of the γ-phase in the plate in a rolling direction was measured.

(3) Shape Recovery Ratio by Shape Memory Effect

After a 2-% bending strain was applied to the iron-based alloy plate in liquid nitrogen, the plate was taken out of the liquid nitrogen, and measured with respect to a radius $R_0$ of curvature in a bent state. The bent plate was heated to 100° C. to cause shape recovery, and then its radius $R_1$ of curvature was measured to calculate the shape recovery ratio by the following formula:

$$\text{Shape recovery ratio (\%)}=100\times(R_1-R_0)/R_1.$$

(4) Maximum Superelasticity Strain (Superelasticity)

Figure 3A:
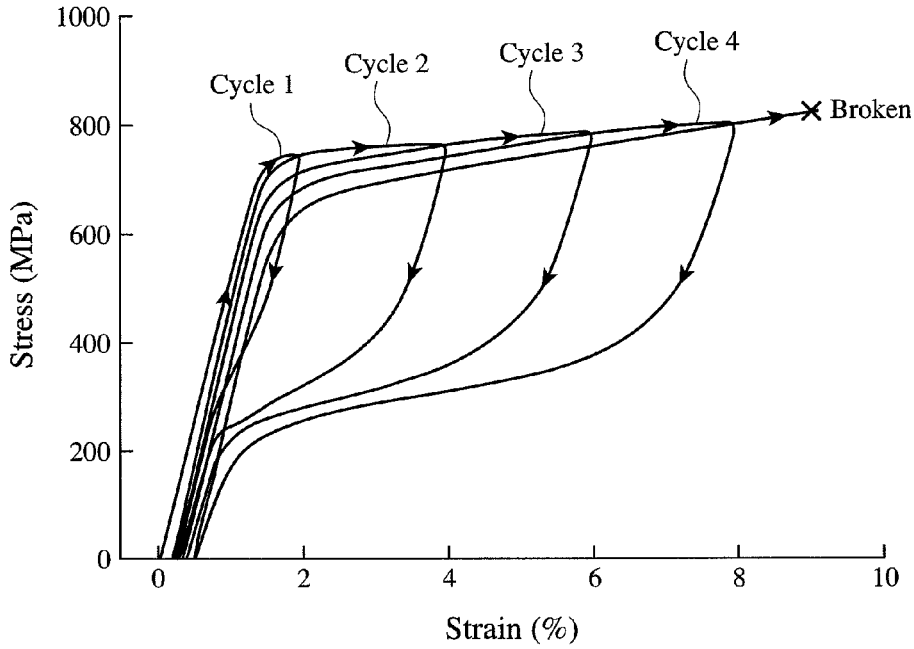
FIG. 3(*a*) is a graph schematically showing a typical stress-strain curve obtained by tensile cycle test of the shape memory alloy.
Figure 3B:
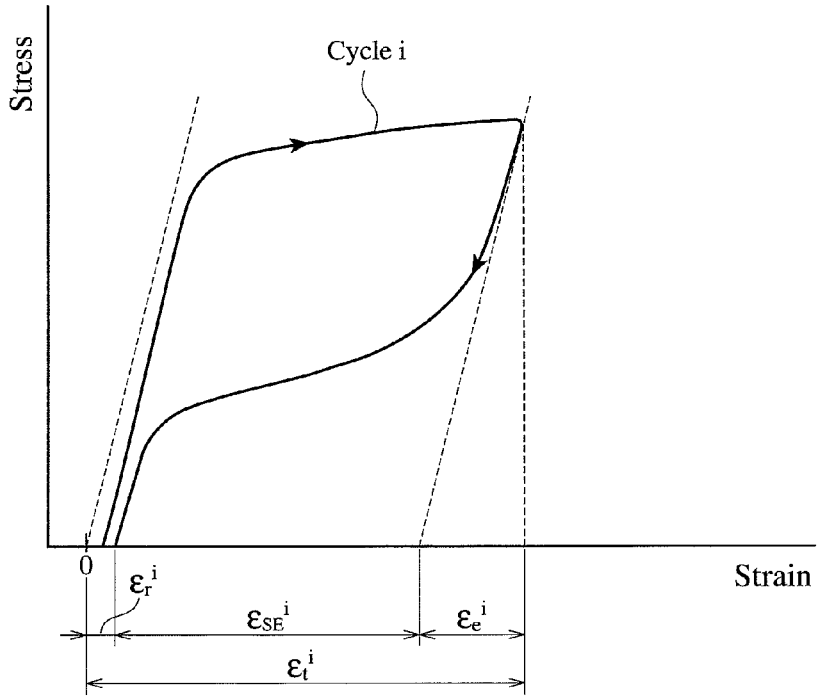

The superelasticity strain was determined from a stress-strain curve obtained by the tensile cycle test of the plate at room temperature. The typical measurement results are shown in FIG. 3(*a*). The tensile cycle test was conducted by repeating cycles each comprising applying a strain increasing from 2% of the initial sample length (cycle 1) to 4% (cycle 2), 6% (cycle 3) . . . to the sample and removing the strain, until the sample was broken. As shown in FIG. 3(*b*), the superelasticity strain ($\epsilon_{SE}^{i}$) in the i-th cycle was determined from the stress-strain curve of the i-th cycle and was defined in the following formula:

$$\epsilon_{SE}^{i}(\%)=\epsilon_t^{i}-\epsilon_r^{i}-\epsilon_e^{i}$$

wherein i represents the number of cycles, $\epsilon_t^{i}$ represents a strain applied in the i-th cycle, $\epsilon_r^{i}$ represents a residual strain in the i-th cycle, and $\epsilon_e^{i}$ represents a elastic strain in the i-th cycle.

Figure 4:
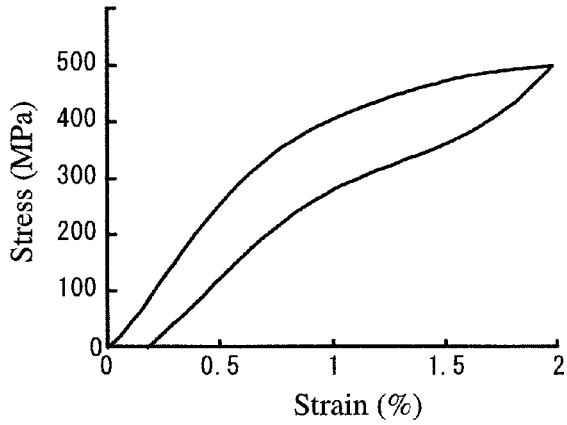
FIG. 4 is a graph showing the stress-strain curve of iron-based alloys plate of Example 3 when the maximum strain is 2%.
Figure 5A:
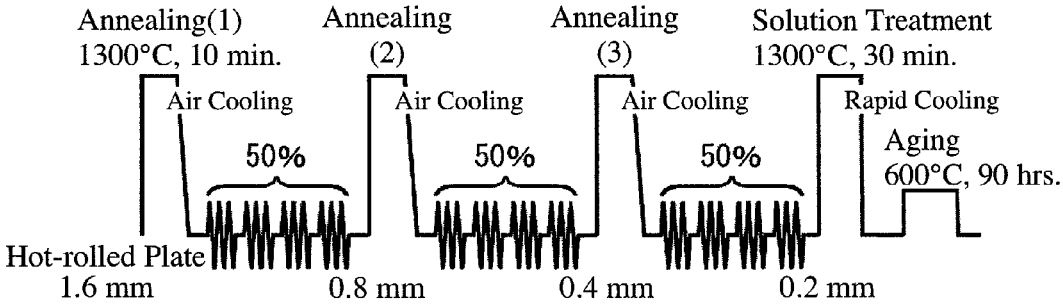
FIG. 5(*a*) is a schematic view showing steps for fabricating the iron-based alloy of Example 6 from a first annealing step to an aging step.
Figure 5B:
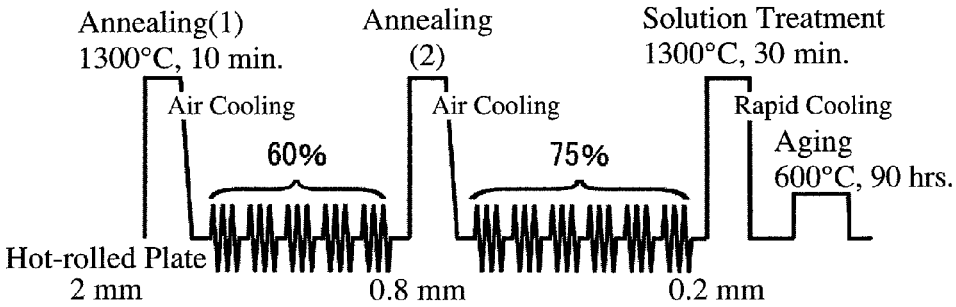
Figure 5C:
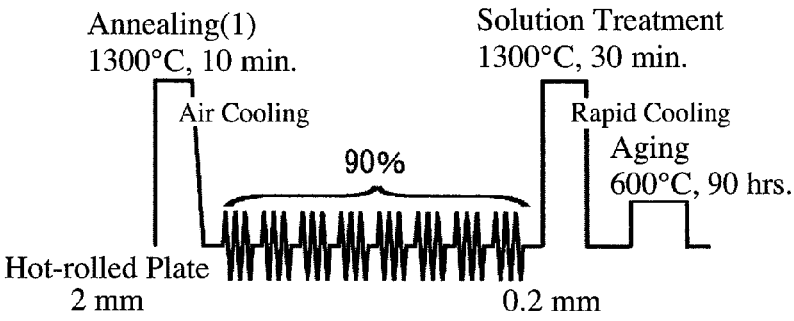
Figure 5D:
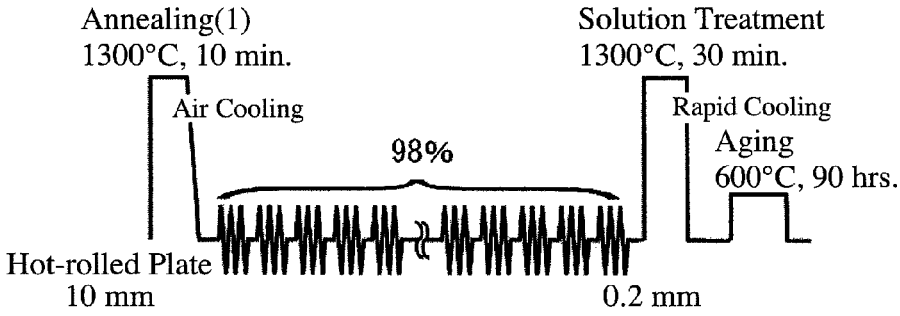
Figure 5E:
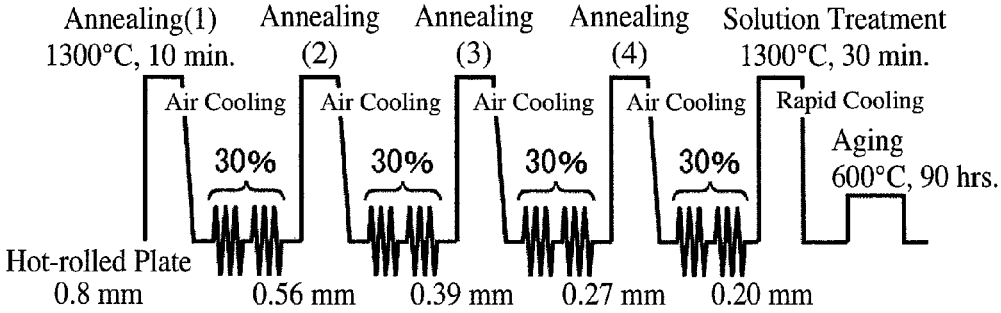

The maximum superelasticity strain obtained until the plate was broken was evaluated by the following criterion. FIG. 4 shows the stress-strain curve of the plate of Example 3 when the maximum strain was 2%.

Excellent: The maximum superelasticity strain was 4% or more.

Good: The maximum superelasticity strain was 2% or more and less than 4%.

Fair: The maximum superelasticity strain was 0.5% or more and less than 2%.

Poor: The maximum superelasticity strain was less than 0.5%.

TABLE 2

| No. | Difference Between Af And Ms (° C.)(1) | Frequency of <100> in Rolling Direction | Shape Recovery Ratio (%) | Super-elasticity |
|---|---|---|---|---|
| Example 1 | 67 | 2.6 | 85 | Fair |
| Example 2 | 41 | 2.6 | 91 | Fair |
| Example 3 | 31 | 2.5 | 93 | Fair |
| Example 4 | 32 | 2.5 | 93 | Good |
| Example 5 | 36 | 2.6 | 92 | Fair |
| Comp. Ex. 1 | 200 | 2.6 | 78 | Poor |

Note:
(1)The difference between a reverse transforming-finishing temperature (Af) and a martensitic transforming-starting temperature (Ms) in the thermal hysteresis of martensitic transformation and reverse transformation (correlated with the thermal hysteresis width).

As is clear from Table 2, any of Examples 1-5 in which the temperature width of the thermal hysteresis of martensitic transformation and reverse transformation was 100° C. or less exhibited a high shape memory recovery ratio of 80% or more and good superelasticity (maximum superelasticity strain) of 0.5% or more. Comparative Example 1, which had substantially the same frequency of <100> in a rolling direction as in Examples 1-5 but a thermal hysteresis temperature width of 200° C., however, exhibited a shape recovery ratio of less than 80% and superelasticity of less than 0.5%. These results indicate that the iron-based alloys of Examples 1-5 having smaller thermal hysteresis temperature width had better shape memory properties and superelasticity than those of the iron-based alloy of Comparative Example 1 having larger thermal hysteresis temperature width.

Example 6

An iron-based alloy having the same composition as in Example 4 was melted, and solidified at an average cooling speed of 140° C./minute to produce a billet of 20 mm in diameter. This billet was hot-rolled at 1300° C. to a plate of 1.6 mm in thickness. This hot-rolled plate was subjected to first annealing at 1300° C. for 10 minutes, air-cooled, and then cold-rolled plural times to a thickness of 0.8 mm. Thereafter, second annealing, cold rolling, third annealing and cold rolling were conducted under the same conditions to produce a plate of 0.2 mm in thickness. The total working ratio after the third annealing (final annealing) was 50%. The plate was heat-treated at 1300° C. for 30 minutes, and rapidly cooled by quenching in ice water (solution treatment). It was then subjected to an aging treatment at 600° C. for 90 hours, to obtain an iron-based alloy plate having a two-phase structure comprising a γ phase having an fcc structure and a γ' phase having an $L1_2$ structure, which had shape memory properties and superelasticity. This fabrication process from the first annealing step to the aging step in Example 6 is schematically shown in FIG. 5(*a*).

Examples 7-9 and Comparative Example 2

An iron-based alloys having the same composition as Example 6 were annealed and cold-rolled in each pattern shown in FIGS. 5(*b*) to 5(*e*). FIG. 5(*b*) shows Example 7, FIG. 5(*c*) shows Example 8, FIG. 5(*d*) shows Example 9, and FIG. 5(*e*) shows Comparative Example 2. The total cold-working ratios after the final annealing are shown in Table 3.

With respect to Examples 6-9 and Comparative Example 2, the frequency of <100> in a rolling direction, the shape recovery ratio and the superelasticity were measured by the same methods as in Example 4, and the percentage of low-angle grain boundaries having an orientation difference of 15° or less was measured by an electron backscattering pattern analyzer. The results are shown in Table 3 together with the total cold-working ratio after the final annealing.

TABLE 3

| No. | Total Cold Working Ratio After Final Annealing (%) | Difference Between Af and Ms (° C.) | Frequency of <100> in Rolling Direction | Low-Angle Grain Boundaries (%) | Shape Recovery Ratio (%) | Super-elasticity |
|---|---|---|---|---|---|---|
| Example 6 | 50 | 30 | 2.3 | 23 | 92 | Fair |
| Example 7 | 75 | 32 | 2.8 | 34 | 93 | Good |
| Example 8 | 90 | 31 | 6.4 | 46 | 97 | Excellent |
| Example 9 | 98 | 32 | 11.0 | 50 | 97 | Excellent |
| Comp. Ex. 2 | 30 | 30 | 1.5 | 7 | 85 | Poor |

Figure 6:
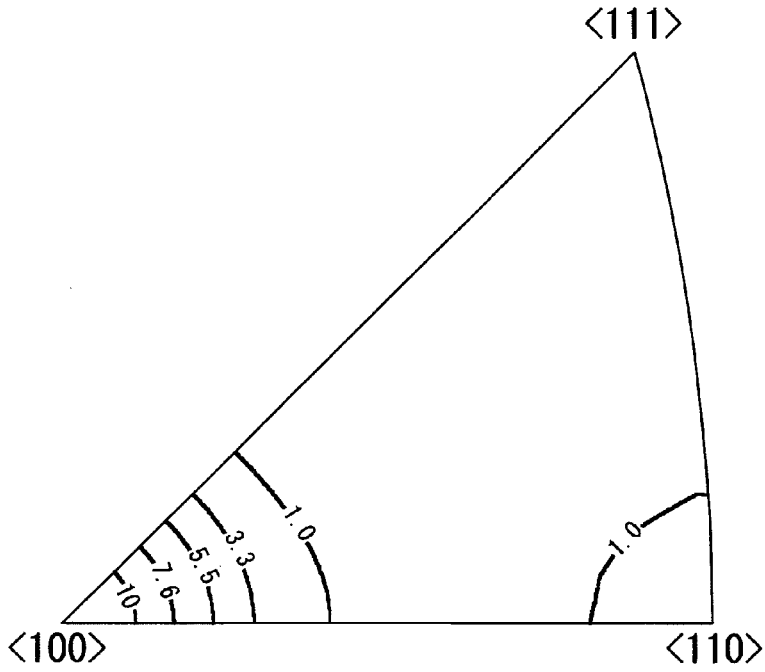
FIG. 6 is an inverse pole figure showing the frequency of crystal orientations of the γ phase in a rolling direction in the iron-based alloy plate of Example 9.
Figure 7:
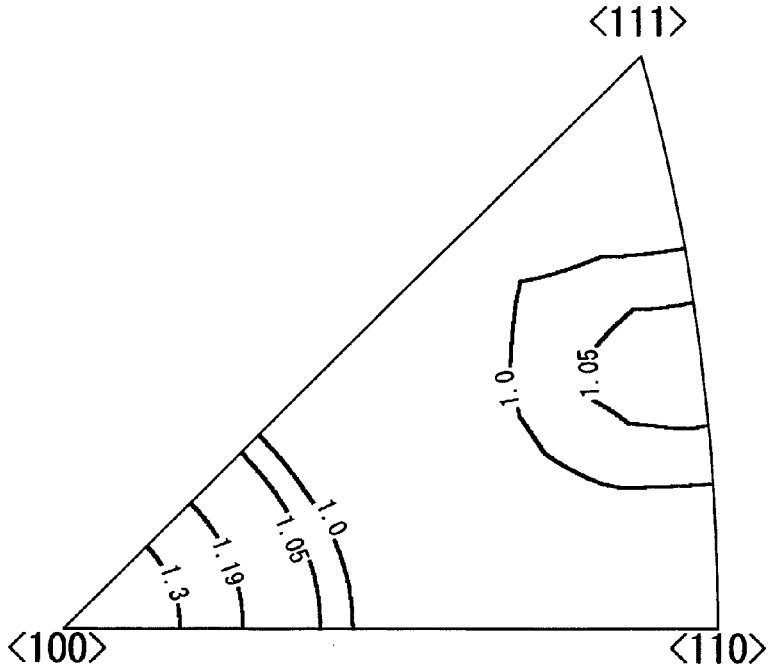
FIG. 7 is an inverse pole figure showing the frequency of crystal orientations of the γ phase in a rolling direction in the iron-based alloy plate of Comparative Example 2.
Figure 8:
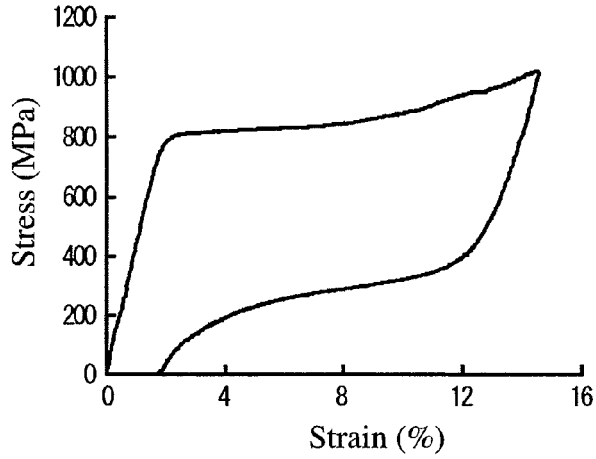
FIG. 8 is a graph showing a stress-strain curve of the iron-based alloys plate of Example 9 when the maximum strain is 15%.

FIGS. 6 and 7 are inverse pole figures each showing the frequency of crystal orientations in a rolling direction by contours in each plate of Example 9 and Comparative Example 2, respectively. In Example 9 (FIG. 6), the contours gathered in the <100> direction, the <100>directions being aligned with the rolling direction, and the frequency of <100> in a rolling direction being 11.0. In Comparative Example 2 (FIG. 7), the crystal orientations were scattering substantially at random, so that the frequency of <100> in a rolling direction was 1.5. FIG. 8 shows the stress-strain curve of Example 9 when the maximum strain was 15%. It is clear from FIG. 8 that Example 9 had superelasticity strain of about 13%.

As is clear from Table 3, in each of Examples 6-9 in which the total working ratio after the final annealing was 50% or more, the frequency of <100> in a rolling direction was 2 or more, with the <100>direction aligned to the rolling direction. Also, with the percentage of low-angle grain boundaries, whose orientation difference was 15° or less, being 20% or more, any of Examples 6-9 exhibited a shape recovery ratio of 90% or more and superelasticity of 0.5% or more. In Comparative Example 2 in which the total working ratio after the final annealing was 30%, however, the frequency of <100> in a rolling direction was 1.5, the <100> direction being substantially at random. Also, the percentage of low-angle grain boundaries with orientation difference of 15° or less was 7% or less, and the shape recovery ratio was less than 90%, and the superelasticity was less than 0.5%. It is clear from these results that an iron-based alloy having a higher total cold-working ratio after the final annealing has more aligned crystal orientations, thereby having higher shape memory properties and superelasticity.

Example 10

Figure 9:
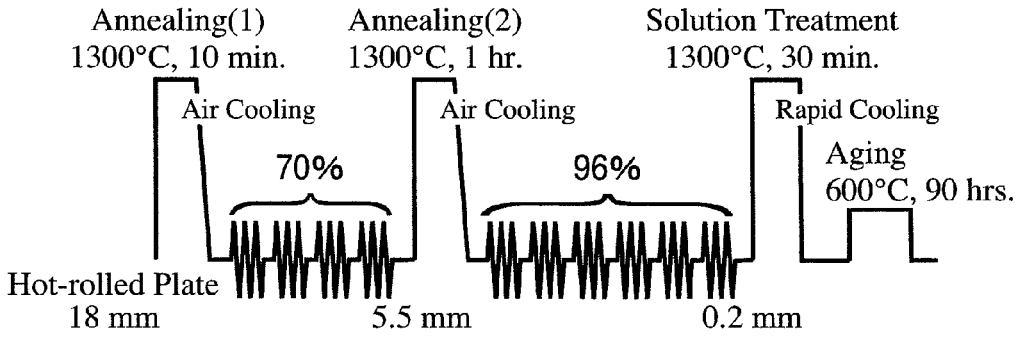
FIG. 9 is a schematic view showing steps for fabricating the iron-based alloy of Example 10 from a first annealing step to an aging step.

An iron-based alloy having the same composition as in Example 4 was melted, and solidified at an average cooling speed of 140° C./minute to produce a billet of 25 mm each. The billet was hot-rolled at 1250° C. to a plate of 18 mm in thickness. The hot-rolled plate was subjected to plural cycles each comprising first annealing at 1300° C. for 10 minutes, cooling with air and cold-rolling, to produce a plate of 5.5 mm in thickness. The plate was further subjected to plural cycles each comprising second annealing at 1000° C. for 1 hour, cooling with air and cold-rolling, to produce a plate of 0.2 mm in thickness. The plate was heat-treated at 1300° C. for 30 minutes, and rapidly cooled by quenching in ice water. It was then subjected to an aging treatment at 600° C. for 90 hours to obtain an iron-based alloy plate having a two-phase structure comprising a γ phase having an fcc structure and a γ' phase having an $L1_2$ structure, which had shape memory properties and superelasticity. This fabrication process from the first annealing step to the aging step are schematically shown in FIG. 9. The plate thus obtained was measured as follows.

(1) Change of Magnetization Curve Caused by Temperature Change

Figure 10:
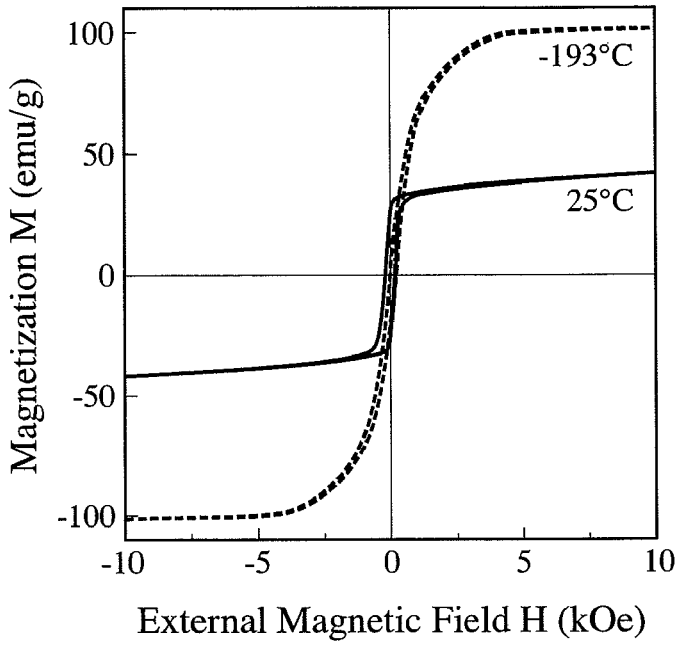
FIG. 10 is a graph showing the magnetization curve of the iron-based alloys plate of Example 10.

Using a vibrating sample magnetometer (VSM), the magnetization properties of the iron-based alloy plate were measured by applying an external magnetic field parallel to the surface of the plate at 25° C., which was higher than Af (austenite phase), and at −193° C., which was lower than Ms (austenite phase+martensite phase). The results are shown in FIG. 10. The saturation magnetization of the plate drastically increased due to the formation of martensite phase.

(2) Change of Magnetization Curve with Strain Applied

Figure 11:
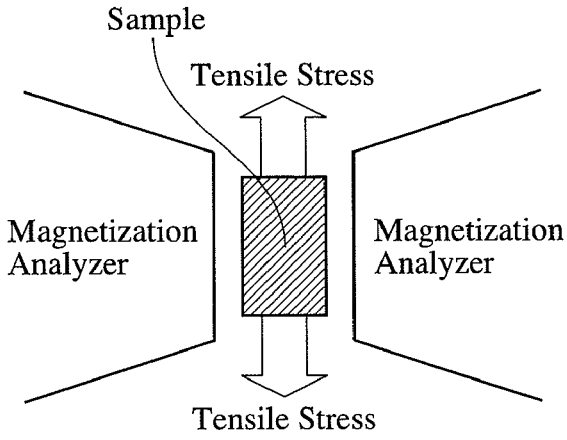
FIG. 11 is a schematic view showing an apparatus for measuring the magnetic properties of the iron-based alloys plate of Example 10 in a state where a strain is applied.
Figure 12:
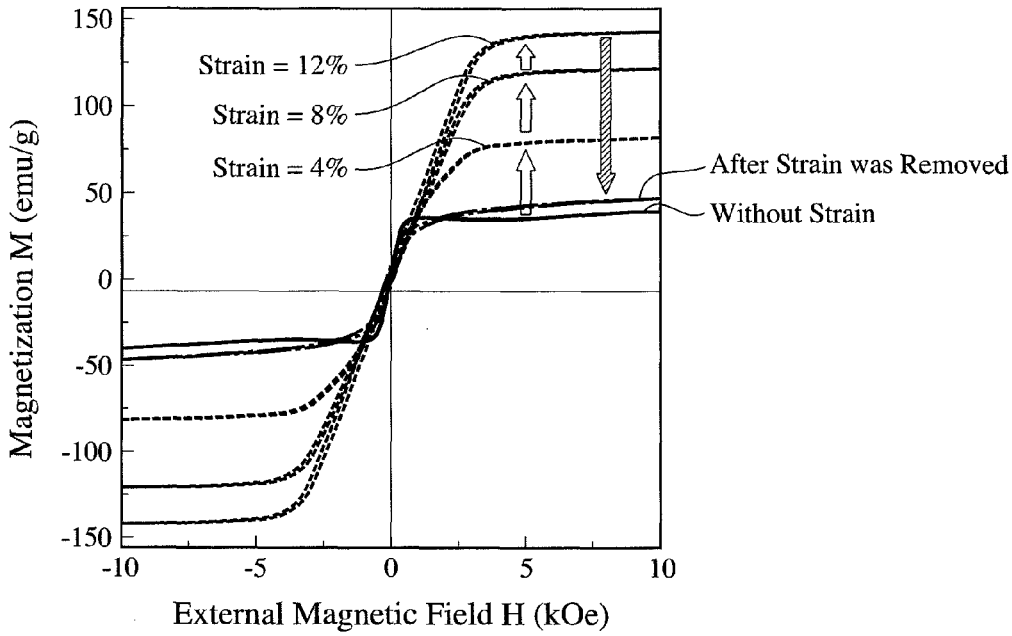
FIG. 12 is a graph showing the magnetization curve of the iron-based alloy plate of Example 10 before and while a tensile strain is applied, and after the strain is removed.

As shown in FIG. 11, the magnetization of the iron-based alloy plate was measured while applying tensile strain of 0%, 4%, 8% and 12% at 25° C., where an external magnetic field was applied perpendicularly to the tensile direction. The results are shown in FIG. 12. The application of strain increased a volume fraction of a martensite phase (stress-induced transformation), thereby increasing the saturation magnetization. After removing the tensile strain, the magnetization returned to the same level as before deformation because of superelasticity.

(3) Magnetostriction

Figure 13:
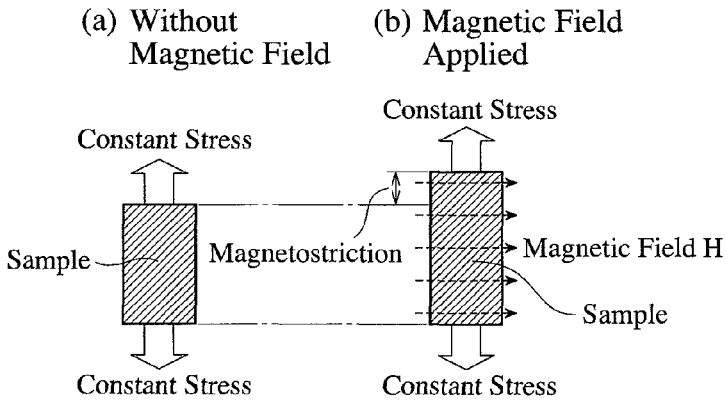
FIG. 13 is a schematic view showing a method for measuring a strain induced when a magnetic field is applied to the iron-based alloy plate of Example 10.
Figure 14:
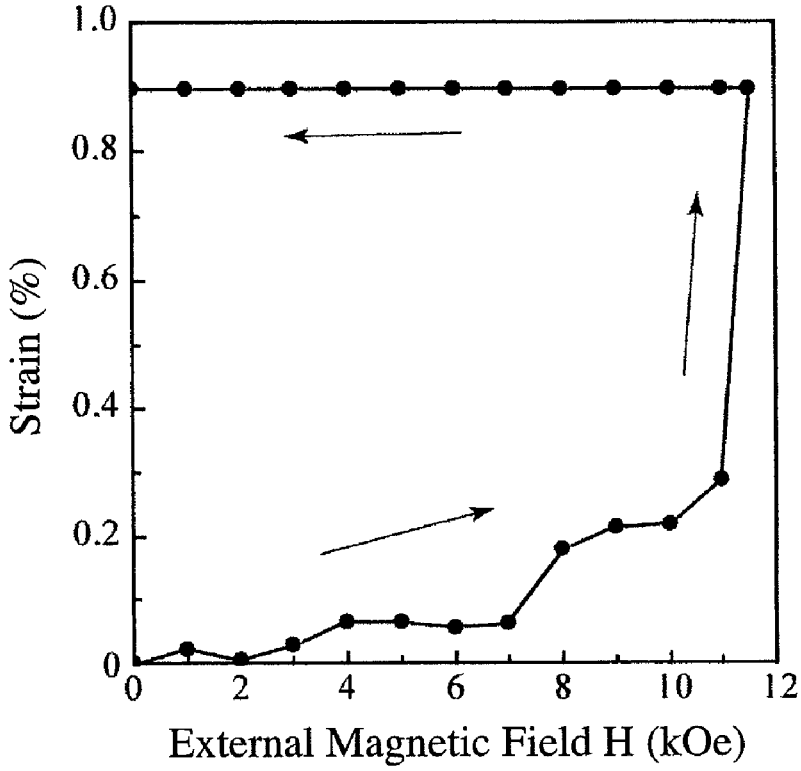
FIG. 14 is a graph showing the relation between a magnetic field and a strain in the iron-based alloy plate of Example 10.

As shown in FIG. 13, the iron-based alloy plate was subjected to apply a constant tensile stress without a magnetic field, and a magnetic field was then applied to the plate at 25° C. to measure the change of strain in a stress-applying. The results are shown in FIG. 14. The strain gradually increased as the external magnetic field increased, and drastically increased to the maximum magnetostriction of 0.9% when the external magnetic field exceeded about 11 kOe. After removing the external magnetic field, the strain did not return to the original level.

APPLICABILITY IN INDUSTRY

The iron-based alloy of the present invention has stable and good shape memory properties, and large superelasticity that cannot be obtained by conventional polycrystalline shape memory alloys such as Ti—Ni alloys, Cu-based alloys, etc., in a practical temperature range. In addition, it enjoys a low material cost and excellent workability, usable for various products such as wires, plates, foils, springs, pipes, etc. It is usable as a substitute for conventional shape memory alloys in dampers of microwave ovens, air direction controllers of air conditioners, various liquid or vapor pressure control valves, vents for buildings, antennas of cell phones, spectacles frames, brassieres, functional members for medical equipments such as catheter guide wires and stents, sport goods such as golf clubs and tennis rackets, and as new applications such as structural members, building members, bodies and frames of trains and automobiles, etc.

Because the iron-based alloy of the present invention is ferromagnetic, it can be used for magnetic field-driven devices such as magnetic field-driven micro-actuators and magnetic field-driven switches, stress-magnetism functional devices such as magnetic strain sensors, etc. Further, because it undergoes large change of magnetization (increase in saturation magnetization) by the martensitic transformation, it can be used for temperature-sensitive magnetic devices utilizing the change of magnetization caused by a temperature change (transformation between the matrix and the martensite phase), magnetic strain sensors utilizing the change of magnetization caused by the application and removal of strain, and giant magnetostriction devices utilizing martensitic transformation caused by applying a magnetic field to the matrix.

The iron-based alloy of the present invention has a recrystallization texture having a γ phase with aligned crystal orientations, the difference between a reverse transformation-finishing temperature and a martensitic transformation-starting temperature being 100° C. or less in the thermal hysteresis of martensitic transformation and reverse transformation, it has much improved shape memory properties and superelasticity than those of conventional iron-based alloys. In addition, the iron-based alloy of the present invention, which is an Fe—Ni—Co—Al alloy, has a low material cost and excellent workability and corrosion resistance, suitable for products such as wires, plates, foils, springs, pipes, etc.

What is claimed is:

1. An iron-based alloy having shape memory properties and superelasticity, which has a composition consisting of 25-35% by mass of Ni, 13-25% by mass of Co, 2-8% by mass of Al, and 1-20% by mass in total of at least one selected from the group consisting of 2-10% by mass of Nb and 3-20% by mass of Ta, optionally 0.001-1% by mass in total of at least one selected from the group consisting of B, C, Ca, Mg, P, S, Zr, Ru, La, Hf, Pb and a misch metal or 0.001-10% by mass in total of at least one selected from the group consisting of Be, Si, Ge, Mn, Cr, V, Mo, W, Cu, Ag, Au, Ga, Pd, Re and Pt, the balance being substantially Fe and inevitable impurities, and a recrystallization texture substantially composed of a γ phase and a γ' phase, a frequency of a <100> direction of said γ phase in a cold-working direction being 2 or more, and the difference between a reverse transformation-finishing temperature and a martensitic transformation-starting temperature being 100° C. or less in the thermal hysteresis of martensitic transformation and reverse transformation.

2. The iron-based alloy according to claim 1, wherein 20% or more of the grain boundaries of said γ phase are low-angle grain boundaries having orientation differences of 15° or less.

3. The iron-based alloy according to claim 1, wherein the Ni content is 26-30% by mass.

4. The iron-based alloy according to claim 1, wherein the Al content is 4-6% by mass.

* * * * *